United States Patent [19]

Yoshimura et al.

[11] Patent Number: 4,838,812

[45] Date of Patent: Jun. 13, 1989

[54] SHIELDED ELECTRIC CONNECTOR AND WIRE CONNECTING METHOD

[75] Inventors: Yoshikazu Yoshimura; Kihachiro Koike, both of Tokyo, Japan

[73] Assignees: Hirose Electric Co., Ltd.; NEC Corporation, both of Tokyo, Japan

[21] Appl. No.: 186,227

[22] Filed: Apr. 26, 1988

[30] Foreign Application Priority Data

Apr. 30, 1987 [JP] Japan ..... 62-106598

[51] Int. Cl.[4] ..... H07R 4/66

[52] U.S. Cl. ..... 439/610; 439/98

[58] Field of Search ..... 439/610, 98, 99

[56] References Cited

U.S. PATENT DOCUMENTS

| | | | |
|---|---|---|---|
| 4,449,778 | 5/1984 | Lane | 439/610 |
| 4,453,798 | 6/1984 | Asick et al. | 439/610 |
| 4,457,576 | 7/1984 | Cosmos et al. | 29/857 |
| 4,641,906 | 2/1987 | Olsson | 439/610 |
| 4,737,124 | 4/1988 | Ezure et al. | 439/610 |
| 4,744,769 | 5/1988 | Grabbe et al. | 439/610 |
| 4,747,785 | 5/1988 | Roberts et al. | 439/610 |

FOREIGN PATENT DOCUMENTS 59-27480 2/1984 Japan .

*Primary Examiner*—Gary F. Paumen

*Attorney, Agent, or Firm*—Fleit, Jacobson, Cohn, Price, Holman & Stern

[57] ABSTRACT

A shielded electric connector comprises contact pins each of which includes a contact portion for coming into contact with a mating contact piece, on one end thereof and a joint portion for connecting an electric wire to be connected, on the other end side thereof, an insulating housing in which the contact pins are disposed and held, a shield hood member which includes a front envelope that encloses the contact pins disposed and held in the insulating housing and a rear envelope that is so formed as to be continuous to and unitary with the front envelope, that is open on only one side and that is formed with an electric wire lead-out portion, a shield lid member adapted to be coupled to the shield hood member in a manner to close the opening of the shield hood member, and a shield connection part adapted to be connected to a shield layer of the electric wires. A method of connecting electric wires to such shielded electric connector is also disclosed.

4 Claims, 6 Drawing Sheets

SHIELDED ELECTRIC CONNECTOR AND WIRE CONNECTING METHOD

BACKGROUND OF THE INVENTION

1. Field of the Invention

The present invention relates to a shielded electric connector which reduces radio-frequency and electromagnetic interferences, and a wire connecting method therefor.

2. Description of the Prior Art

Heretofore, in an electric connector for use in computer equipment, by way of example, noise has entered an electronic signal transmitted by an electric cable or the like, due to a radio frequency or any other electromagnetic wave carried in the air, and the computer equipment or the like has experienced interference. Accordingly, it has been necessary to take a measure against such electromagnetic interferences. An electric connector with such a countermeasure has hitherto been disclosed in the official gazette of Japanese Patent Application Laid-Open No. 27480/1984.

The prior-art shielded electric connector is a shielded electric connector comprising a connector shell of metal material which is coupled to an insulating terminal block for supporting terminals electrically connected to conductors of shielded cable that includes a cable having a plurality of coated conductors, an outer insulating jacket enclosing the conductors, and a shield layer interposed between the conductors and the jacket, the conductors and the shield layers being extended from an end of the insulating jacket. It comprises a pair of metallic shield members which are opposingly arranged between the connector shell and the insulating jacket, means to couple the opposingly-arranged shield members to each other, means to electrically connect the shield members to the connector shell, and an outer insulating shell of unitary structure which encloses the shield members, a part of the connector shell and a part of the insulating jacket.

Since the conductors of the cable and the terminals connected with the conductors are substantially completely enclosed with the pair of shield members opposingly arranged, such a prior-art shielded electric connector has the advantage that it can be shielded from electromagnetic waves.

The prior-art shielded electric connector as stated above, however, has the following problems:

(1) The shield members and the connector shell are constructed by separate elements, and the means for connecting them is soldering, brazing, metal spray, welding, mechanical clamping means, or an electrically-conductive binder. Therefore, the assemblage is laborious, the cost is high, and mass production is impossible.

(2) Also means for connecting the shield members and the shield layer is soldering, metal spray, mechanical clamping, welding, bonding means, or the like. Therefore, the assemblage is very difficult, the cost is high, and mass production is impossible.

(3) Since the shield members and the connector shell are constructed by separate elements, the number of components increases accordingly, and the number of steps for assemblage increases, too.

An object of the present invention is to provide a shielded electric connector and a wire connecting method therefor which can solve the problems of the prior art as mentioned above.

SUMMARY OF THE INVENTION

According to an aspect of this invention, there is provided a shielded electric connector comprising contact pins each of which includes a contact portion for coming into contact with a mating contact piece, on one end side thereof and a joint portion for connecting an electric wire to be connected, on the other end side thereof, an insulating housing in which the contact pins are disposed and held, a shield hood member which includes a front envelope that encloses the contact pins disposed and held in the insulating housing and a rear envelope that is so formed as to be continuous to and unitary with the front envelope, that is open on only one side and that is formed with an electric wire lead-out portion, a shield lid member adapted to be coupled to the shield hood member in a manner to close the opening of the shield hood member, and a shield connection means adapted to be connected to a shield layer of the electric wires.

According to an another aspect of this invention, there is provided a method of connecting electric wires to a shielded electric connector of a type as described above, comprising the steps of connecting terminal end parts of the electric wire to be connected, to the joint portions of the corresponding contact pins disposed in the insulating housing, placing the insulating housing on a front end part of the shield lid member and connecting the shield connection portion of the shield lid member to the shield layer of the electric wires, and thereafter installing the insulating housing in the shield hood member so as to enclose the contact portions of the contact pins with the front envelope of the shield hood member and coupling the shield lid member to the shield hood member so as to close the opening of the shield hood member and to lead out the electric wires from the electric wire lead-out portion of the shield hood member.

This invention will now be described in further detail with regard to preferred embodiments as illustrated in the accompanying drawings.

DESCRIPTION OF THE PREFERRED EMBODIMENTS

Figure 1:
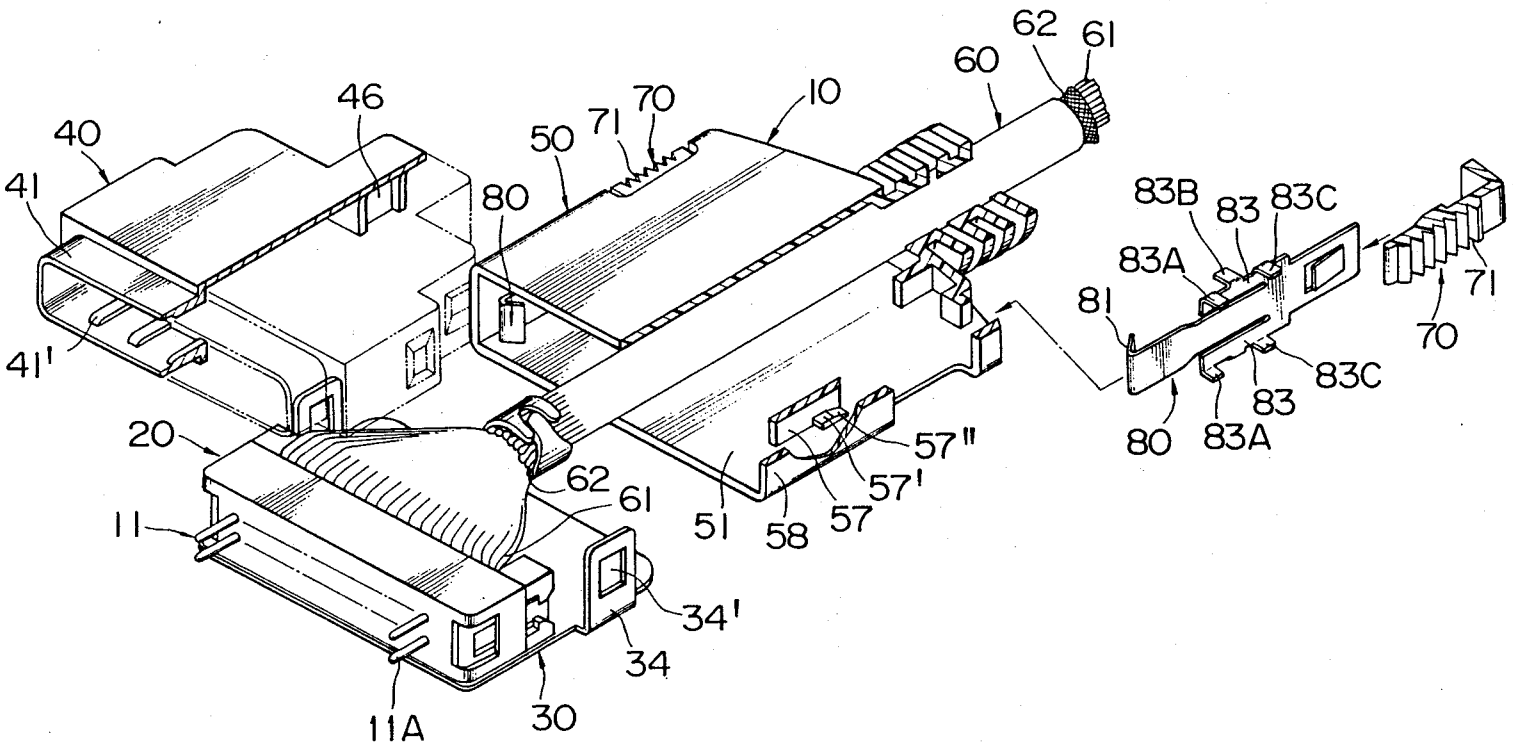
FIG. 1 is an exploded perspective view, partly broken away, of a shielded electric connector which is an embodiment of the present invention.

Referring now to FIG. 1, there is shown a shielded electric connector 10 according to an embodiment of this invention. The connector 10 comprises principally contact pins 11, an insulating housing 20, a shield lid member 30, a shield hood member 40, an insulating hood 50, buttons 70, and engagement fixtures 80.

The contact pin 11 may be one usually used in an electric connector of this type, and is formed of an electrically-conductive metal material. On one end side, it has a contact portion 11A which comes into contact with the contact piece of a mating connector, while on the other end side, it has a joint portion (not appearing in the figures) which serves to electrically connect the electric wire 61 of a cable 60.

The insulating housing 20 is unitarily molded of a plastics material, and it has the plurality of contact pins 11 disposed and held therein in such a manner that the contact portions 11A are protruded from the front end thereof.

Figure 3A:
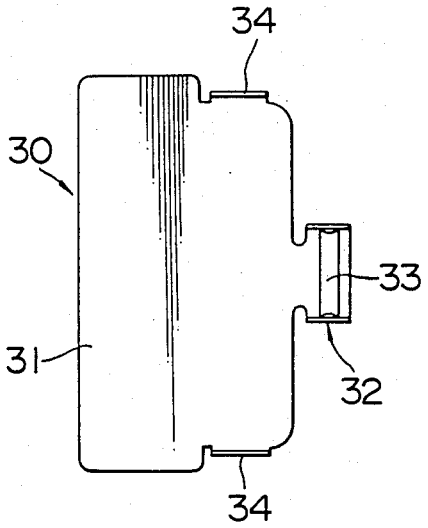
FIG. 3A is a front view of the shield lid member of the shielded electric connector of FIG. 1.
Figure 3C:
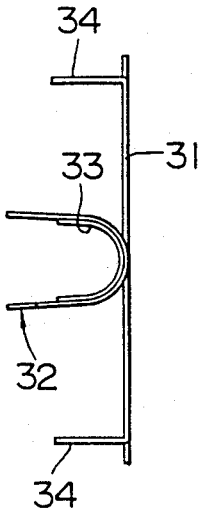
FIG. 3C is a plan view of the shield lid member of FIG. 3A.
Figure 3B:
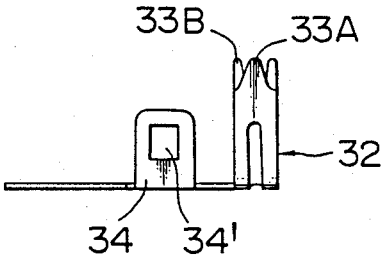
FIG. 3B is a side view of the shield lid member of FIG. 3A.

As clearly shown in FIGS. 3A, 3B and 3C, the shield lid member 30 is formed by punching and bending a springy metal material, in such a manner that a flat portion 31 for placing the insulating housing 20 thereon is provided at the front part of this member 30 (the left part as seen in FIG. 3A), while a shield connection portion 32 being substantially in the shape of the letter U is protrusively provided at the rear end part of this member. The shield lid member 30 is formed with engaging arms 34 which protrude sideward of this member in the same direction as that of the shield connection portion 32 at positions intermediate between the flat portion 31 and the shield connection portion 32 and each of which has an opening 34′ that engages the protrusion 43′ of the outer wall of the shield hood member 40 to be explained later.

Figure 4A:
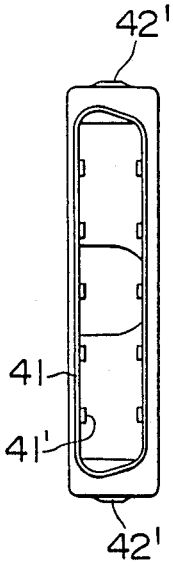
FIG. 4A is a bottom view of the shield hood member of the shielded electric connector of FIG. 1.
Figure 4B:
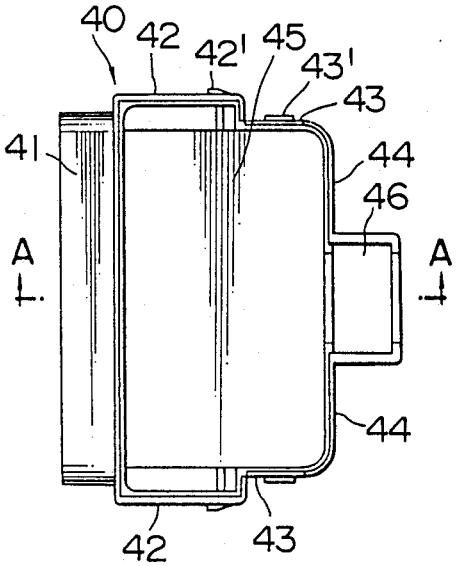
FIG. 4B is a front view of the shield hood member of FIG. 4A.
Figure 4C:
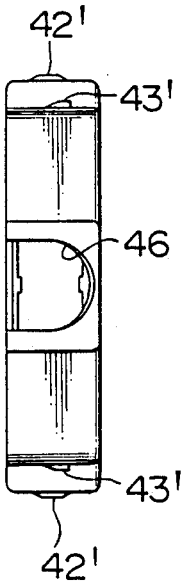
FIG. 4C is a plan view of the shield hood member of FIG. 4A.
Figure 4D:
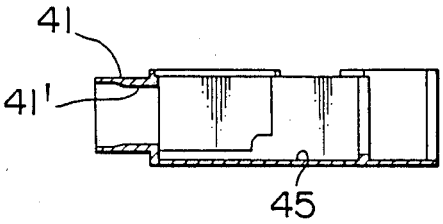
FIG. 4D is a side view of the shield hood member of FIG. 4A.

As clearly shown in FIGS. 4A, 4B, 4C and 4D, the shield hood member 40 is unitarily molded of a metal material by, for example, die casting, in a manner to include a front envelope 41 which envelops the contact portions 11A of the contact pins 11 disposed in the insulating housing 20 and which is formed at the front part of this member 40 (the left part as seen in FIG. 4B), as well as a rear envelope which is formed rearward of the front envelope 41 so as to be continuous thereto and unitary therewith. The rear envelope is made up of an enveloping flat portion 45 including first side surfaces 42, second side surfaces 43 and shoulder side surfaces 44 which are set upright at the peripheral edges of the member 40. Accordingly, this rear envelope is open in only one side surface (an upper surface in FIG. 4D). In addition, a U-shaped groove 46 is provided in the rear part of the enveloping flat portion 45, the groove receiving the shield connection portion 32 of the shield lid member 30 which is pressedly fixed to the shield layer 62 of the cable 60. This U-shaped groove 46 constructs an electric wire lead-out portion for leading out the cable 60 rearwards. On the inner surface of the front envelope 41, a plurality of ribs 41′ for ensuring a firmer shield connection with the metal shell of the mating connector are circumferentially provided. Besides, the first side surfaces 42′ and second side surfaces 43 are respectively provided with protrusions 42′ and 43′ which fulfill functions to be described later.

Figure 5A:
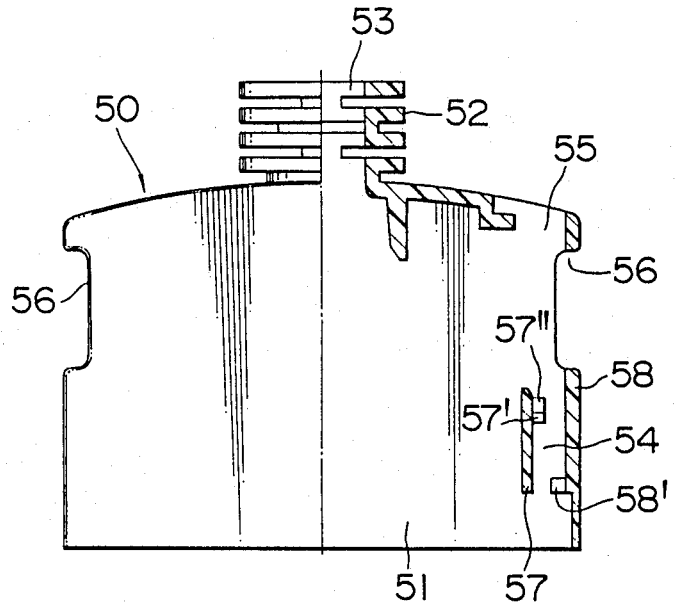
FIG. 5A is a half-sectional front view of the insulating hood of the shielded electric connector of FIG. 1.
Figure 5B:
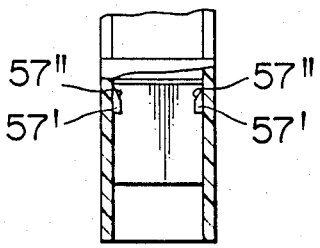
FIG. 5B is a partial vertical sectional view of the side part of the insulating hood of FIG. 5A.

As clearly shown in FIGS. 5A and 5B, this insulating hood 50 is unitarily molded of a plastic material, in a manner to include a hollow 51 which accommodates the shield lid member 30 and shield hood member 40 unitarily assembled as will be stated later, and a fin 52 which has a through hole 53 for causing the cable 60 to penetrate it. On both the sides of the hollow 51, there are provided engagement fixture receiving portions 54 for accommodating the engagement fixtures 80, and button receiving portions 55 for accommodating the buttons 70. The button receiving portion 55 is formed with a recess 56 for exposing the antiskid corrugation 71 of the button 70. On the other hand, the engagement fixture receiving portion 54 is defined between an inner side wall 57 and an outer side wall 58, and a pair of engagement projections 57′ fulfilling a function to be stated later are provided on the inner side wall 57, while a pair of stopper lugs 58′ fulfilling a function to be stated later are provided on the inner side of the outer side wall 58. As clearly shown in FIG. 5B, the engagement projection 57′ is provided with a tapered portion 57″.

Figure 6A:
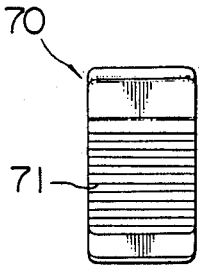
FIG. 6A is a front view of the button of the shielded electric connector of FIG. 1.
Figure 6B:
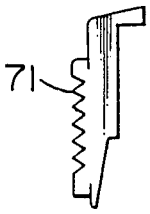
FIG. 6B is a side view of the button of FIG. 6A.
Figure 6C:
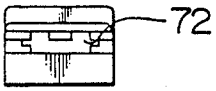
FIG. 6C is a bottom view of the button of FIG. 6A.

As clearly shown in FIGS. 6A, 6B and 6C, the button 70 is molded of a plastics material, and it is provided with the antiskid corrugation 71 which protrudes from the recess 56 of the insulating hood 50 and which serves to depress the hook 81 of the engagement fixture 80 with a finger, and a fixation groove 72 which serves to receive and fix the button mounting portion 82 of the engagement fixture 80 on the opposite side to the antiskid corrugation 71.

Figure 7A:
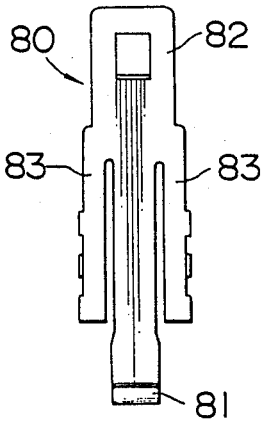
FIG. 7A is a front view of an engagement fixture of the shielded electric connector of FIG. 1.
Figure 7B:
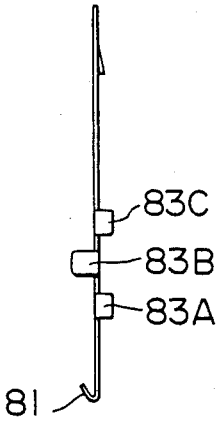
FIG. 7B is a side view of the engagement fixture of FIG. 7A.

As clearly shown in FIGS. 7A and 7B, the engagement fixture 80 is formed of a springy metal material by punching and bending, in such a manner that the hooked engagement portion 81 is provided at the extreme end of this fixture, while the button mounting portion 82 is formed on the other end side. Springy or elastic pieces 83 are provided on both the sides of the engagement fixture 80 substantially in the middle thereof. As clearly shown in FIG. 7B, each elastic piece 83 is formed with a first coming-off-preventive bend 83A, a second coming-off-preventive bend 83B and a stabilizer bend 83C which fulfill functions to be described later.

Next, there will be described the procedural steps by which the shielded electric connector of such construction is assembled, and the wires of the cable are joined.

(1) First, the cover of a cable 60 is peeled off to expose wires 61. Besides, the terminal parts of the individual wires 61 are jointed by soldering, crimp contact, pressure welding or the like to the joint portions of contact pins 11 which are disposed and held in an insulating housing 20. On that occasion, the shield layer 62 of the cable 60 is preferably exposed and then fixed by, e.g. winding an electrically-conductive tape or the like outside this shield layer 62. In addition, the cable 60 is passed through the through hole 53 of the fin of an insulating hood 50 as illustrated in FIG. 1.

(2) Subsequently, the insulating housing 20 thus jointed to the wires is placed on the front part of the flat portion 31 of a shield lid member 30, while the shield layer 62 of the cable 60 fixed by the electrically-conductive tape or the like is inserted into the U-shaped shield connection portion 32 of the shield lid member 30, and the shield connection portion 32 is caulked and fixed to the shield layer 62 by a caulking tool (not shown). In this case, it is recommended that a convex rib 33 is formed on the inner surface of the U-shaped shield connection portion 32 as clearly shown in FIG. 3C and that both the free end edges of the shield connection portion 32 are corrugated at parts of reference numerals 33A and 33B as clearly shown in FIG. 3B. The reason is that, in this way, the electrical connection and mechanical connection between the shield connection portion 32 and the shield layer 62 are made better by the caulking.

(3) Subsequently, the insulating housing 20 in the state of the preceding item (2) is inserted inside a shield hood member 40, namely, into the enveloping flat portion 45 thereof. On this occasion, the shield lid member 30 is registered with the shield hood member 40 so that the openings 34' of the engaging arms 34 of the former may correspond to the protrusions 43' of the latter, and the protrusions 43' are inserted into the openings 34', whereby the shield hood member 40 is placed on the shield lid member 30 and coupled and fixed thereto so as to close the opening of the rear envelope of the former. At this time, the contact portions 11A of the contact pins 11 disposed in the insulating housing 20 are inserted inside and enclosed with the front envelope 41 of the shield hood member 40. Further, the shield connection portion 32 of the shield lid member 30 is set in the U-shaped groove 46 of the shield lid member 40. The coupling and fixation of the shield lid member 30 to the shield hood member 40 are effected in such a way that the protrusions 43' snap into the openings 34'.

(4) Thereafter, the shield hood member 40 and the shield lid member 30 are gradually inserted and received into the hollow 51 of the insulating hood 50 in which the cable 60 penetrates the through hole 53. Then, the inner side walls 57 of the insulating hood 50 run onto protrusions 42' provided on the first side surfaces 42 of the shield hood member 40. When the members 40 and 30 are inserted more, the rear end faces of the inner side walls 57 and the protrusions 42' come into engagement as clearly shown in FIG. 2, whereby the insulating hood 50 is fixed to the shield hood member 40 in firm engagement.

Figure 2:
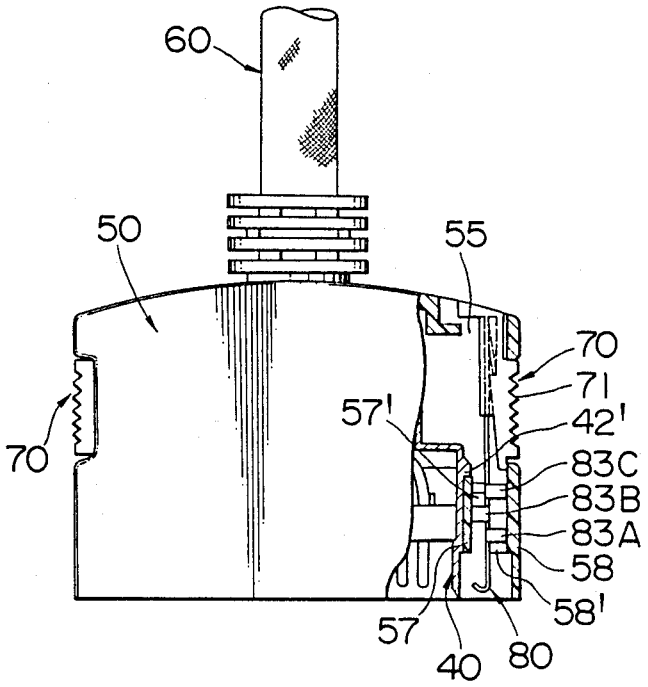
FIG. 2 is a fragmentary front view showing the wire-connected and assembled state of the shielded electric connector of FIG. 1.

(5) Lastly, engagement fixtures 80 with buttons 70 attached thereto are inserted from above the insulating hood 50 into engagement fixture receiving portions 54 provided on both the sides of the hollow of the insulating hood 50 and are thus fastened. Then, the assemblage and the wire jointing of this shielded electric connector are completed. The state of such fitting and fixation of the engagement fixture 80 to the insulating hood 50 is clearly shown in the fragmentary part of FIG. 2. The fitting and fixation of the engagement fixture 80 to the insulating hood 50 will be described in more detail. The engagement fixture 80 is gradually inserted from a button receiving portion 55 on the upper side of the insulating hood 50. Then, a coming-off-preventive bend 83A with which the elastic piece 83 of the engagement fixture 80 is provided abuts against and gets on the tapered portion 57| of the engagement projection 57' of the engagement fixture receiving portion 54, and it passes the projection 57'. Further, a coming-off-preventive bend 83B subsequently gets on the engagement projection 57' and passes it in a similar manner. Besides, the coming-off-preventive 83A abuts against the stopper lug 58' of the receiving portion 54 and comes in engagement therewith. The lower end of a stabilizer head 83C abuts against the inner surface of an outer side wall 58, thereby functioning to stabilize the latch action of the engagement fixture 80 more. On this occasion, the button 70 passes the button receiving portion 55 while bending the engagement fixture 80 inwards, and the antiskid corrugation 71 of the button 70 is exposed from the recess 56 of the insulating hood 50 as shown in FIG. 2.

Although in the above-mentioned embodiment the shield connection portion 32 is formed integrally with the shield lid member 30, the shield connection portion may be formed integrally with the shield hood member 40.

Since the present invention is constructed as stated above, the following effects are attained:

(1) Since a shield hood member is unitarily formed with a front envelope for completely enclosing the contact portions of contact pins, the assemblage is easy, mass production is permitted and the cost can be sharply reduced.

(2) Since a connector is sealed by only a shield hood member and a shield lid member, the number of components is very small, and the number of steps for assemblage becomes the smallest, so the cost is low and that the reliability becomes favorable.

(3) A shield lid member of simple construction is placed on a shield hood member, and an insulating hood which has also a simple construction is placed outside them, thereby to obtain a shielded electric connector which is covered with a perfect insulator. Therefore, it is possible to obtain with ease an electric connector which is of good finger touch and which has a design of low cost and good appearance because the insulating hood can be made colorful.

What is claimed is:

1. A shielded electrical connector comprising:

contact pins, each of said contact pins including a contact portion for contacting with a mating contact piece on one end thereof and a joint portion for connecting an electric wire to be connected on the other end thereof;

an insulating housing, said contact pins being disposed and held in said insulating housing, said insulating housing having an elongated rectangular cross-section having long sides and short sides;

a shield hood member; and a shield lid member, said shield lid member being integrally made of a metallic material and including a flat portion for placing said insulating housing with a said long side of said insulating housing on a surface of said flat portion, a shield connecting portion provided at a generally central portion of a rear end of said flat portion and being substantially U-shaped and extending in a direction substantially perpendicular to a plane of said flat portion and to a side of said flat portion on which said insulating housing is placed and a pair of engaging arms each provided at each side of said flat portion and extending in a direction substantially perpendicular to the plane of said flat portion and to the side of said flat portion on which said insulating housing is placed, said shield hood member being integrally made of a metallic material and including a front envelope for completely surrounding at least said contact portions of said contact pins disposed in said insulating housing, said front envelope being hollow and having an elongatedly rectangular cross-section having long sides and short sides, a rear envelope connected to a rear end of said front envelope and an electric wire lead-out portion connected to a generally central portion of the rear end of said rear envelope and having a U-shaped groove, said rear envelope having walls which are completely continuous, except for an opening which is to be completely closed by said flat portion of said shield lid member, a portion of said rear envelope communicating with said front envelope and a portion of said rear envelope communicating with said electric wire lead-out portion, said walls including an enveloping flat wall portion extending from one of the long sides of the rear end of said front envelope to said electric wire lead-out portion, side wall portions set upright at each side of said enveloping flat wall portion and extending rearwardly from each of the short sides of the rear end of said front envelope, and shoulder side wall portions set upright at each side of said enveloping flat wall portion and extending from a rear end of each of said side wall portions to each side of said electric wire lead-out portion, each of said side wall portions being provided with an engaging portion which is to be engaged by one of said engaging arms of said shield lid member, whereby said insulating housing is placed on said flat portion of said shield lid member with terminal end parts of said electric wire being connected to said joint portions of the corresponding contact pins and a shield layer of said electric wire being connected to said shield connecting portion by crimping, and said insulating housing is installed in said shield hood member with the contact portions of said contact pins being surrounded by said front envelope of said shield hood member and said shield connecting portion being disposed in said U-shaped groove of said electric wire lead-out portion, and said shield lid member is coupled to said shield hood member to close said opening of said shield hood member by engaging each of said engaging arms with the corresponding engaging portion of said shield hood member.

2. A shielded electrical connector as claimed in claim 1, wherein said engaging portions include protrusions provided on an outer side of said side wall portions of said shield hood member, and said engaging arms are provided with openings adapted to engage with said protrusions.

3. A shielded electrical connector as claimed in claim 1, wherein an insulating hood is provided for accommodating and enveloping said shield hood member and said shield lid member.

4. A shielded electrical connector as claimed in claim 3, wherein said insulating hood is provided with inner side walls and said shield hood member is provided on outer sides of said side wall portions thereof with further protrusions, whereby said insulating hood is coupled and fixed to said shield hood member by engaging said further protrusions with said inner side walls.

* * * * *